United States Patent [19]

Kifferstein et al.

[11] 4,157,631

[45] Jun. 12, 1979

[54] TOY FLYING SAUCER

[76] Inventors: Harry P. Kifferstein, 27250 Harvard, Southfield, Mich. 48076; Warren M. Kifferstein, 29632 Middlebelt, Farmington Hills, Mich. 48024

[21] Appl. No.: 788,279

[22] Filed: Apr. 18, 1977

[51] Int. Cl.[2] ..... A63H 33/18

[52] U.S. Cl. ..... 46/74 D

[58] Field of Search ..... 46/74 D; 273/106 B

[56] References Cited

U.S. PATENT DOCUMENTS

| | | | |
|---|---|---|---|
| 3,082,572 | 3/1963 | Knox, Jr. | 46/74 D |
| 3,673,732 | 7/1972 | Liotta | 46/74 D |
| 3,742,643 | 7/1973 | Keith | 46/74 D |
| 3,828,466 | 8/1974 | Geiger | 46/74 D |
| 4,023,805 | 5/1977 | Sherill | 46/74 D |

*Primary Examiner*—Louis G. Mancene
*Assistant Examiner*—Robert F. Cutting
*Attorney, Agent, or Firm*—Hauke and Patalidis

[57] ABSTRACT

An improved toy flying saucer having a relatively thin circular body formed with an upwardly concave shape and an integral concentric peripheral annular portion having a downwardly concave section. The annular peripheral portion may be provided with radial members to which decorative streamers may be attached or which, in the alternative, are arranged to produce noise, or are shaped as airfoils to increase the lift of the toy flying saucer when propelled through the air.

8 Claims, 11 Drawing Figures

FIG. 1
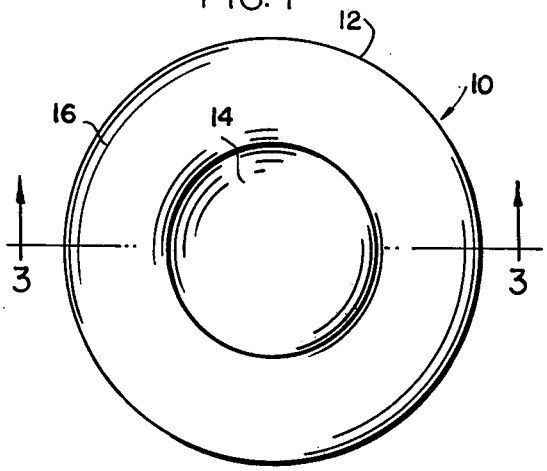
FIG. 2
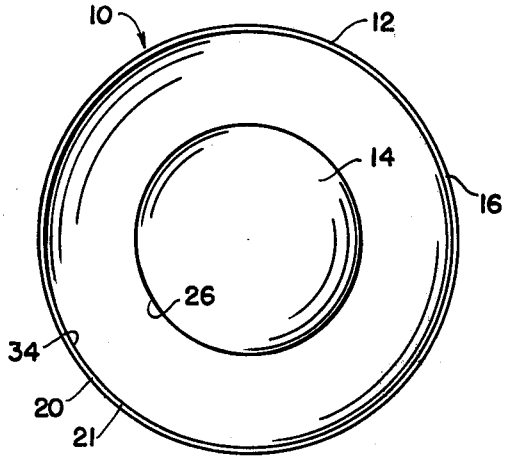
FIG. 4
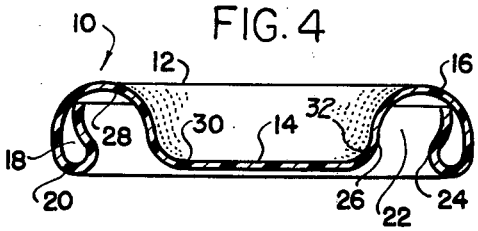
FIG. 3
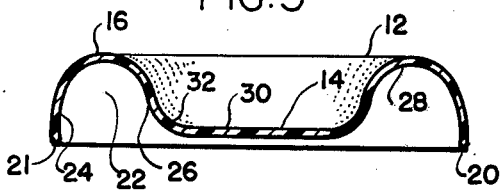
FIG. 6
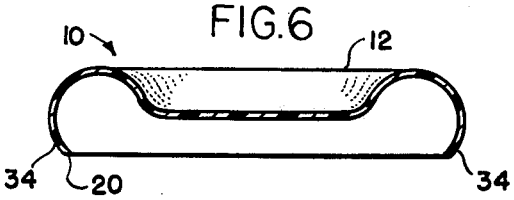
FIG. 5
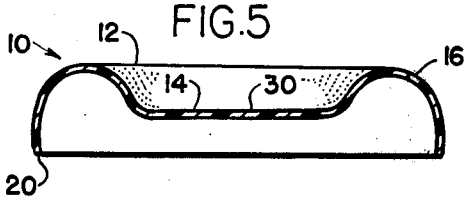
FIG. 7
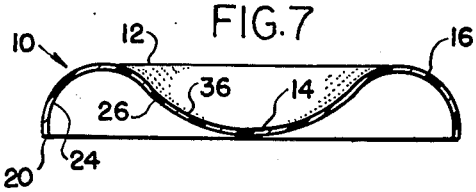
FIG. 8
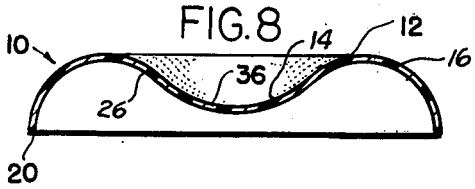
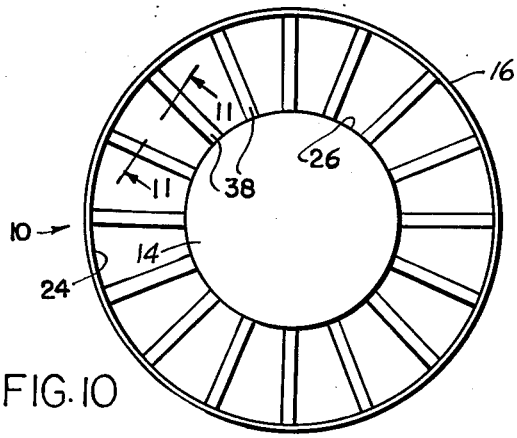
FIG. 10
FIG. 9
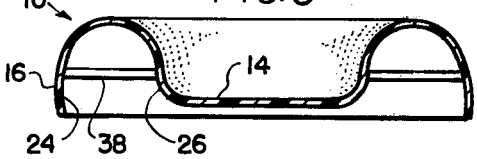
FIG. 11
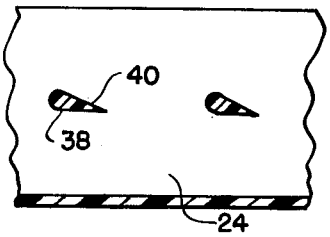

TOY FLYING SAUCER

BACKGROUND OF THE INVENTION

The invention relates to aerodynamic toys for throwing through the air and more particularly to saucer-shaped flying toys.

Toy flying saucers have become very popular over the past years and have enjoyed great popularity as recreational articles for use in games and contests. Toy flying saucers are generally made in the form of a disk of plastic material with a rim portion at its periphery and with a central dome or flat portion, molded integrally with the rim. The toy flying saucer is manually grasped at the rim and is thrown in the air with a spinning motion.

In conventional toy flying saucers, as presently found on the market, the rim of the body extends downwardly a certain distance below the central portion of the body which is generally upwardly convex, in the form of a dome sometimes provided with a substantially flat center portion. Such a configuration is based on the aerodynamic principle that air trapped and compressed below the dome of the saucer body imparts an improved lift providing sustained flight in the air.

The present invention, by contrast, is directed to a toy flying saucer configuration wherein the central portion of the body, instead of being crowned upwardly, is crowned downwardly. Such a configuration presents the advantages that the flying saucer body may be made of thinner material, as a result of a shape provided with reverse curve convolutions greatly increasing the rigidity of the body and, more importantly yet, the configuration of the invention provides greatly improved aerodynamic characteristics. The annular peripheral portion of the saucer body of the invention has a concavity directed downwardly, thus tending to compress and entrap a volume of air within the annular cavity at the periphery of the saucer body. Some of the entrapped air is caused to spill over the rim, as in conventional toy flying saucers, but the majority of the entrapped air is caused to circulate, before spilling over the rim, towards the central body portion forming a surface disposed at the inner rim of the annular peripheral portion. Lift is thus applied both to the annular portion and to the central body portion. In addition, the concavity of the upper surface of the central body portion, while the toy flying saucer of the invention is projected through the air, creates a suction applied to the top of the central portion which increases further the lift exerted on the flying saucer during flight.

A further advantage resulting from the shape of the flying saucer according to the present invention is due to the peripheral annular portion of the body being provided with a pair of concentric walls across which radial members may be mounted, giving a plurality of choice as to the function of such radial members. For example, such radial members may be used for attaching streamers providing a decorative effect during flight of the flying saucer, or they may be shaped to act as air-operated noise makers, or as spoilers, or as additional lifting surfaces.

SUMMARY OF THE INVENTION

The present invention therefore provides a novel toy flying saucer of improved configuration and flying ability as a result of forming a flying saucer body with an annular peripheral portion having a concavity downwardly disposed and an integral central body portion having a concavity upwardly disposed.

Further objects and advantages of the present invention will become apparent to those skilled in the art when the following description of the best modes contemplated for practicing the invention is read in conjunction with the accompanying drawing wherein:

BRIEF DESCRIPTION OF THE DRAWINGS

FIG. 1 is a top plan view of a toy flying saucer configuration according to the present invention;

FIG. 2 is a bottom plan view thereof;

FIG. 3 is a sectional view along line 3—3 of FIG. 1;

FIG. 4 is a view similar to FIG. 3, but showing a modification thereof;

FIG. 5 is a view similar to FIG. 3, and showing a further modification thereof;

FIG. 6 is a view similar to FIG. 5, but showing another modification thereof;

FIG. 7 is a view similar to FIG. 3, and showing a further modification thereof;

FIG. 8 is a view similar to FIG. 7, but showing a further modification thereof;

FIG. 9 is a view similar to FIG. 3, and showing another modification thereof;

FIG. 10 is a bottom plan view of the configuration of FIG. 9; and

FIG. 11 is a partial sectional view along line 11—11 of FIG. 10.

DETAILED DESCRIPTION OF THE PREFERRED EMBODIMENTS

Referring now to the drawing and more particularly to FIGS. 1-3, a toy flying saucer 10 according to the present invention comprises a generally circular or disk shaped body 12 having a central body portion 14 and an integral concentric peripheral annular portion 16. As best shown at FIG. 3, the central body portion 14 and the peripheral annular portion 16 are integrally formed of relatively thin material such as an impact resistant thermoplastic material molded in one piece.

The embodiments of FIGS. 1-3 and FIG. 4, respectively, are substantially alike, except that the annular peripheral portion 16 has a reinforced hollow rim portion 18, in the structure illustrated at FIG. 4, while in the embodiment of FIGS. 1-3, the peripheral annular portion 16 is provided with a simple edge 20, preferably rounded as shown at 21. The peripheral annular portion 16 defines a toric cavity 22 having a concavity directed downwardly during normal flight of the toy flying saucer 10, disposed between a pair of concentric sidewalls 24 and 26 joined by a dome-like curved top portion 28.

In both embodiments illustrated respectively at FIGS. 1-3 and FIG. 4, the central body portion 14 of the flying saucer body 12 is substantially flat, as shown at 30, and is disposed proximate to and above a circular plane whose perimeter is defined by the edge 20 of the annular peripheral portion 16. The flat portion 30 of the central portion 14 merges gradually, as shown at 32, with the inner sidewall 26 of the peripheral annular portion 16. The central portion 14 of the saucer body 12 thus forms a recess having a concavity directed towards the top of the body 12, when in normal flight attitude. One advantage of such a configuration is a greatly improved rigidity of the body 12 which permits to use a thinner wall thickness for the body, with an accompanying improvement in flight characteristics due to light weight and rigidity, and a considerable economy in the quantity of material used for molding the body. By forming the rim of the peripheral annular portion 16 hollow as shown at 18 in FIG. 4, the rigidity of the body 12 is further increased, and even less wall thickness can be used. The peripheral annular portion 16 forms a toric channel 22 tending to entrap air below the flying body, such air spilling in the normal manner over the outer edge 20 of the peripheral annular portion 16 and also beyond the bottom of the sidewall 26 to the underneath of the central body portion 14, thus increasing the lift force exerted on the body 12 when in spinning flight. Furthermore, the presence of the top recess formed between the top 28 of the annular portion 16 and the recessed flat surface 30 of the central body portion 14 creates a drop of air pressure and eddy air currents which increase the lift of the body 12 while in flight, without appreciably increasing the drag.

The embodiment of FIG. 5 contemplates disposing the flat portion 30 of the top body portion 14 farther above the circular plane circumscribed by the edge 20 of the annular body portion 16, such as to slightly increase the volume of air entrapped below the flying body 12 within the perimeter of the edge 20 of the annular peripheral portion 16.

If it is desired to further increase the rigidity of the body 12, the edge 20 of the peripheral annular portion 16 is circularly bent inwardly, as shown at 34 at FIG. 6, with the result that the volume of air spilled over the edge 20 is substantially reduced, and the rigidity of the body 12 is further increased without requiring a reinforced rim or hollow rim 18 as shown at FIG. 4.

The present invention also contemplates a curved, in section, central portion 36 for the body 12, as shown at FIGS. 7 and 8, with gradual and continuous blending of the curved surface central portion 36 into the curved inner sidewall 26 of the peripheral annular portion 16. In the embodiment of FIG. 7, the bottom of the curved central body portion 26 extends proximate the circular plane defined by the perimeter of the edge 20 of the peripheral annular portion 12, while in the configuration of FIG. 8, the bottom of the curved central portion 36 extends only part of the way to the circular plane within the perimeter of the edge 20.

As illustrated at FIGS. 9–10, the invention further contemplates providing a plurality of radially extending members 38 extending across the toric channel defined by the peripheral annular portion 16 of the body 12, between the sidewalls 24 and 26 thereof. The radial members 38 may be made of rigid material or, alternatively, of flexible material, similar to rubber bands and the like, which may be caused to vibrate in flight such as to create a humming or hissing sound. If so desired, some or all of the radial members 38 may be provided with a noise-maker in the form of a whistle or the like. Alternatively, and as shown in better detail at FIG. 11, the radial members 38 may be in the form of airfoils 40 disposed at an appropriate angle of incidence for providing lift to the toy flying saucer when spun in an appropriate direction of rotation at launch.

Having thus described the present invention by way of typical structural embodiments thereof, modifications whereof will be apparent to those skilled in the art, what is claimed as new is as follows:

We claim:

1. A toy flying saucer comprising a relatively thin circular solid imperforate body having a substantially constant thickness and defining a central portion and a concentric peripheral annular portion integrally formed with said central portion, wherein said annular portion is in the form of a toric cavity having a peripheral rim disposed in a single substantially circular plane, and wherein said central portion is in the form of an inverted dome gradually merging into said annular portion and having a top extending downwardly toward and above said circular plane.

2. The toy flying saucer of claim 1 wherein said top of said central body portion inverted dome is substantially flat.

3. The toy flying saucer of claim 2 wherein said central body portion substantially flat top is disposed proximate said circular plane defined by the rim of said annular portion.

4. The toy flying saucer of claim 1 wherein said central body portion is continuously and progressively curved in the form of said inverted dome.

5. The toy flying saucer of claim 4 wherein the top of said central body portion inverted dome is disposed proximate said circular plane defined by the rim of said annular portion.

6. The toy flying saucer of claim 1 wherein said annular portion has a hollow rim.

7. The toy flying saucer of claim 1 further comprising spoke-like members extending radially across said annular portion.

8. The toy flying saucer of claim 7 wherein said spoke-like members are airfoils disposed at an angle such as to increase the lift of said body.

* * * * *